US006736470B2

(12) United States Patent
Manke et al.

(10) Patent No.: US 6,736,470 B2
(45) Date of Patent: May 18, 2004

(54) MOLDED PLASTIC DISHWASHER DOOR ASSEMBLY

(75) Inventors: Darrin S. Manke, North Andover, MA (US); Stephen D. Schober, Newton, IA (US)

(73) Assignee: Maytag Corporation, Newton, IA (US)

( * ) Notice: Subject to any disclaimer, the term of this patent is extended or adjusted under 35 U.S.C. 154(b) by 11 days.

(21) Appl. No.: 09/970,672

(22) Filed: Oct. 5, 2001

(65) Prior Publication Data

US 2003/0067254 A1 Apr. 10, 2003

(51) Int. Cl.[7] ..... A47L 17/00
(52) U.S. Cl. ..... 312/228; 312/257.1; 49/501
(58) Field of Search ..... 312/228, 257.1, 312/263, 265.5, 204; 49/501

(56) References Cited

U.S. PATENT DOCUMENTS

| | | | | |
|---|---|---|---|---|
| 3,294,461 A | | 12/1966 | Barnard et al. | |
| 3,936,107 A | | 2/1976 | Gourdeau et al. | |
| 4,229,921 A | | 10/1980 | Schell | |
| 4,732,431 A | | 3/1988 | Mason | |
| 4,765,697 A | | 8/1988 | Gardell et al. | |
| 4,900,109 A | | 2/1990 | Boston, Jr. et al. | |
| 5,158,346 A | | 10/1992 | Marks et al. | |
| 5,496,104 A | | 3/1996 | Arnold et al. | |
| 5,571,276 A | | 11/1996 | Kobos et al. | |
| 5,603,557 A | | 2/1997 | Marks et al. | |
| 5,647,151 A | * | 7/1997 | Fantone et al. | 40/454 |
| 5,806,942 A | | 9/1998 | Jenkins, Jr. et al. | |
| 6,286,916 B1 | * | 9/2001 | Chen et al. | 312/223.2 |
| 6,389,499 B1 | * | 5/2002 | Frank et al. | 710/300 |

FOREIGN PATENT DOCUMENTS

| | | |
|---|---|---|
| DE | 2710367 | 9/1978 |
| DE | 3107211 | 9/1982 |

* cited by examiner

*Primary Examiner*—Lanna Mai
*Assistant Examiner*—Jeremy A. Anderson
(74) *Attorney, Agent, or Firm*—Diederiks & Whitelaw, PLC

(57) ABSTRACT

A dishwasher door assembly includes a frame, an inner door panel and a decorative outer door panel. The door is assembled by snap-fitting the inner door panel to the frame and then further snap-fitting the decorative outer panel over the frame. Thereafter, mechanical fasteners are inserted in aligned openings formed in the outer door panel, frame and inner door panel. This overall arrangement enables a consumer to select between various decorative outer door panels available to a retailer such that an outer door panel of a desired color and/or style can be sold with the overall dishwasher. The overall door assembly is preferably formed from plastic so as to be lightweight, yet structurally sound.

25 Claims, 4 Drawing Sheets

MOLDED PLASTIC DISHWASHER DOOR ASSEMBLY

BACKGROUND OF THE INVENTION

1. Field of the Invention

The present invention pertains to the art of appliances and, more particularly, to a molded plastic door assembly for a dishwasher.

2. Discussion of the Prior Art

When purchasing a dishwasher, a consumer would typically have to select a particular model, followed by a particular style. For instance, it is common to provide three or more styles for any particular dishwasher model, with the styles generally only differing by the color of the outer surface of a door of the dishwasher. Commonly, dishwasher doors are available in white, almond and black colors. Given that the doors between these various style dishwasher door assemblies only differ in visible appearance, it has been heretofore proposed to construct a dishwasher door with interchangeable front door panels of varying colors. Therefore, it is known to provide dishwashers with interchangeable front panels which advantageously allows a consumer to simply select between various decorative outer door panels when purchasing a particular dishwasher model.

Interchangeable dishwasher panels as proposed in the prior art are typically rectangular in shape and designed to only cover the front side of the dishwasher door. Such door assemblies typically utilize grooves or bracing members along a frame of the dishwasher door for receiving the decorative panel. Often the decorative panels are held in place with retainer strips positioned along an edge of the door frame. This overall arrangement requires the assembly of a fair number of components which must be maintained in respective positions in order to accommodate the retainer strips. The use of these multiple assembly components and the requirement for maintaining a certain alignment during the overall assembly is considered to lead to disadvantageous assembly costs.

In today's marketplace, dishwasher door assemblies, with or without decorative front panels, almost invariably have metal frames. The use of metal in forming door frames is considered to disadvantageously add weight to the overall structure. Most typical assemblies utilize metal screws and the like which require alignment between holes formed in the various components and, inherently, longer assembly times. In any event, for at least these reasons, there exists a need in the art for a dishwasher door assembly that is preferably formed of plastic so as to be lightweight, while being structurally sound. More particularly, there exists a need in the art for a dishwasher door assembly which is simple in construction, incorporates at least a frame and a decorative front panel which can be easily interconnected to the frame in a time efficient and effective manner, with the front panel being of a selected color and/or style.

SUMMARY OF THE INVENTION

The present invention is directed to a dishwasher door assembly including a door frame, an inner door panel and a decorative outer door panel. In accordance with the most preferred embodiment of the invention, the door frame is sandwiched between the inner and outer door panels, with each of the inner and outer door panels being snap-fittingly connected to the door frame. The decorative door panel preferably fits over at least side portions of the door frame.

The door frame actually defines a housing for a control panel, as well as constituting a support for the overall door assembly. In accordance with the invention, each of the door frame, inner door panel and decorative outer door panel are formed of plastic.

In the most preferred form of the invention, side portions of the door frame are formed with slots for receiving tabs provided on each of the outer door panel and inner door panel. That is, the inner door panel includes tabs that extend outward from a body portion thereof. As the inner door panel is joined to the door frame, the tabs register with structure provided on the door frame such that a snap-fit connection is affected. In a similar manner, the decorative outer panel is formed with tabs which are snap-fitted to the door frame. More particularly, the outer door panel is formed with various projections which are slidably received within slots provided in the door frame, whereupon the outer door panel is pivoted and snap-fittingly attached to the door frame about side portions thereof. As the outer door panel and the door frame are joined, the outer door panel covers at least front and side portions of the door frame to establish an overall aesthetic arrangement. Additional mechanical fasteners can be utilized to finalize the overall assembly.

With this construction, the dishwasher door assembly of the present invention presents a lightweight and structurally sound door assembly that can be easily assembled with substantially self-aligning parts being connected in a snap-fit manner. In accordance with the invention, an overall dishwasher model can be selected by a consumer, followed by a particular decorative outer door panel having a desired color and/or style, with the outer door panel being easily attached to the remainder of the door assembly to establish the final product.

Additional objects, features and advantages of the present invention will become more readily apparent from the following detailed description of a preferred embodiment thereof when taken in conjunction with the drawing wherein like reference numerals refer to corresponding parts in the several views.

BRIEF DESCRIPTION OF THE DRAWINGS

FIG. 3 is an exploded, rear perspective view of the dishwasher door assembly of the invention;

DETAILED DESCRIPTION OF THE PREFERRED EMBODIMENT

Figure 1:
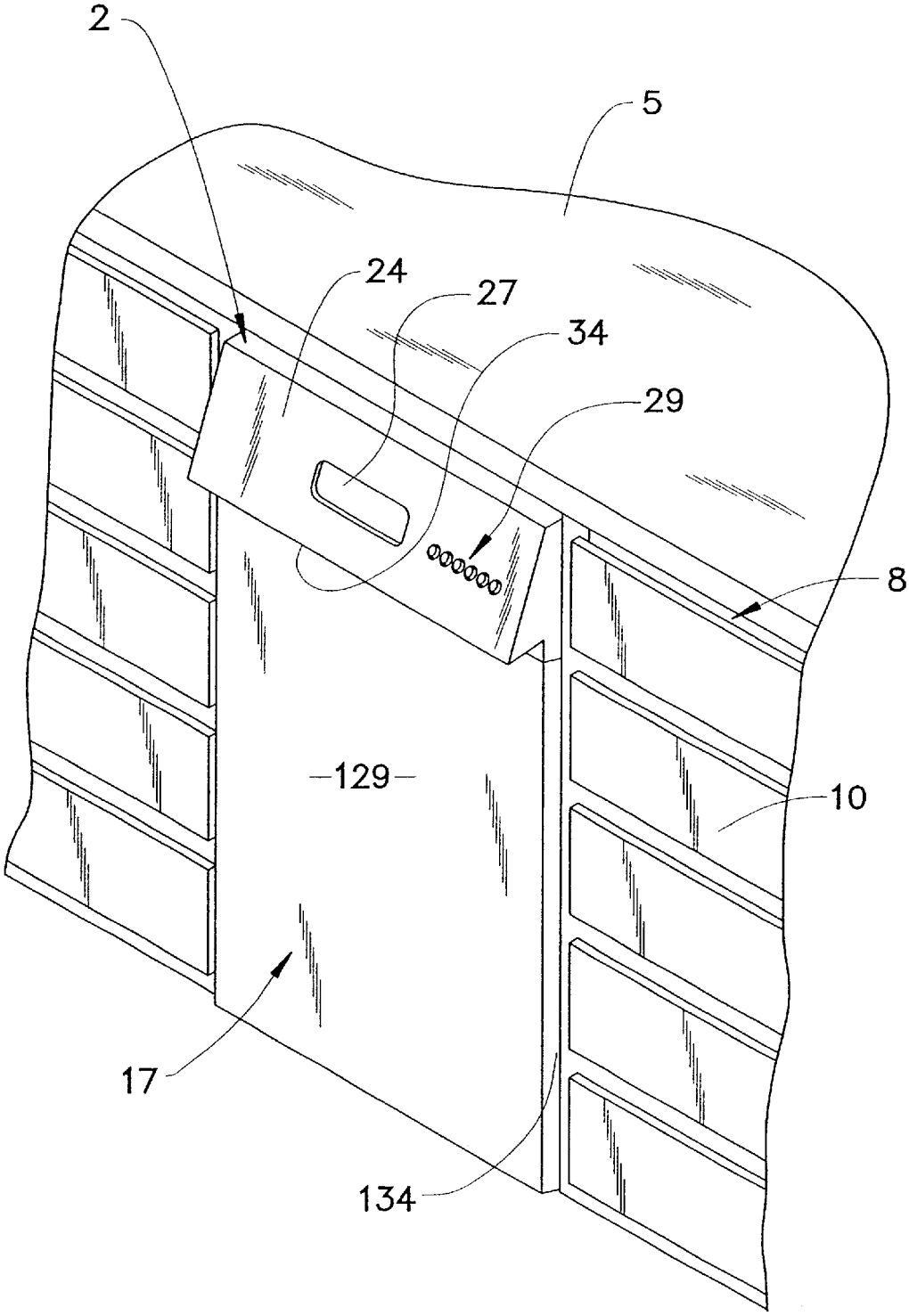
FIG. 1 is a front perspective view of a dishwasher incorporating a door assembly constructed in accordance with the present invention.

With initial reference to FIG. 1, a dishwasher 2 is generally indicated to be positioned below a kitchen countertop 5. Also below countertop 5 is shown cabinetry 8 including two columns of drawers 10. Dishwasher 2 includes a door assembly 17 which is constructed in accordance with the present invention and pivotally mounted for movement relative to a tub 22 (see FIG. 2) of dishwasher 2. Although not shown, dishwasher 2 preferably includes a support frame for tub 22, with dishwasher door assembly 17 being pivotally connected to the support frame. As the pivotable mounting of dishwasher doors are widely known in the art and not considered part of the present invention, this pivotable mounting arrangement will not be discussed further here. As shown, dishwasher 2 includes a control panel 24. In accordance with the preferred embodiment, control panel 24 includes a display 27, as well as a set of buttons, generally indicated at 29, for establishing a desired washing operation. In general, the overall control and operation of dishwasher 2 is also known in the art and will not be discussed in further detail. As further well known in the art, control panel 24 is preferably undercut, such as that indicated at 34, so as to define a handle for use in opening and closing of door assembly 17. Instead, the present invention is particularly directed to the construction of dishwasher door assembly 17 as will be detailed below.

Figure 2:
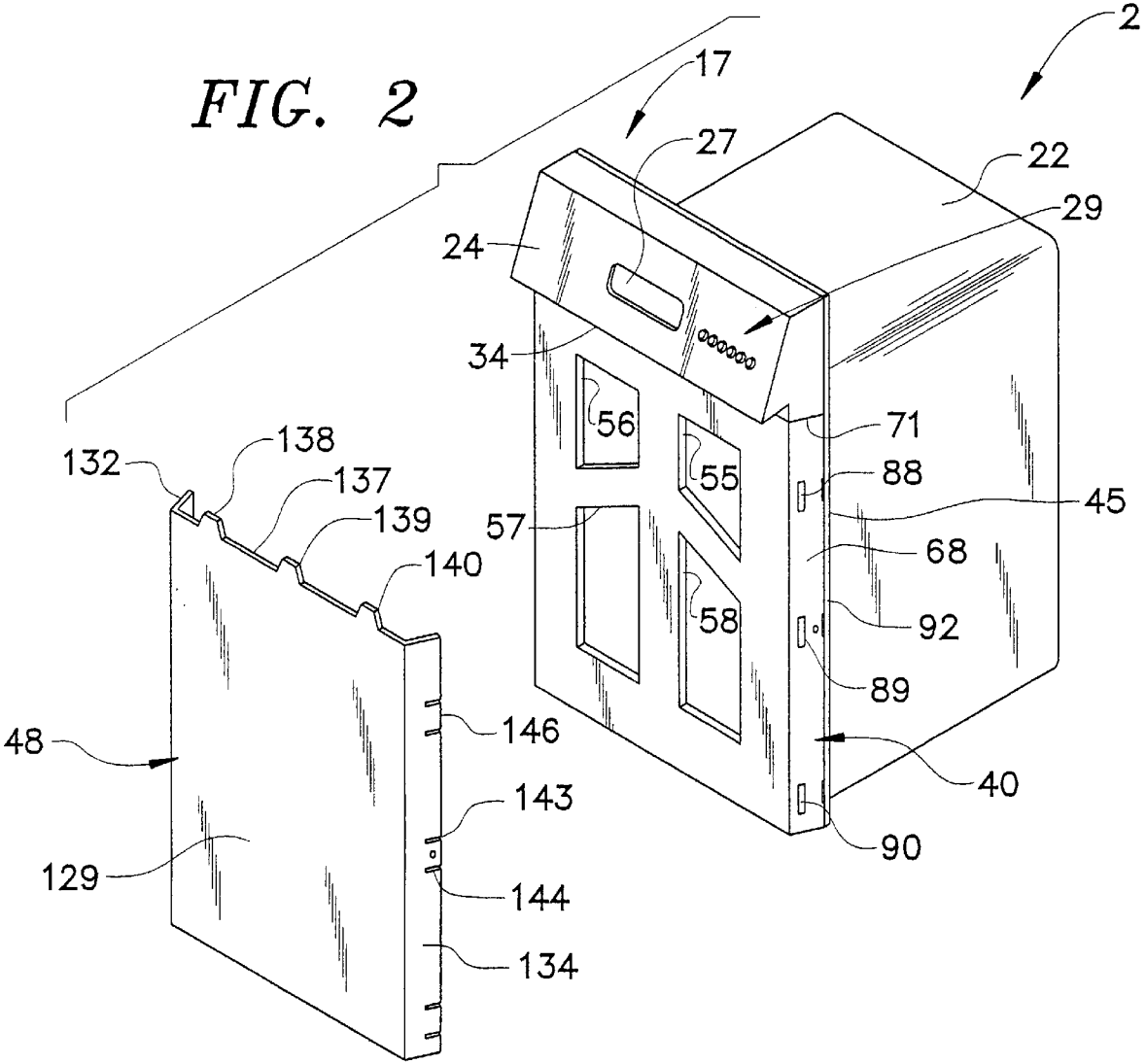
FIG. 2 is a partial exploded view of the door assembly of the present invention, with a decorative outer door panel thereof being shown spaced apart from a remainder of the assembly.

As best shown in FIGS. 2 and 3, dishwasher door assembly 17 has three main components, i.e., a door frame 40, an inner door panel 45 and an outer door panel 48. In accordance with the most preferred form of the invention, door frame 40 is molded of plastic and includes a main body portion 52 provided with various cut-out sections 55–58. Arranged above cut-out portions 55–58 is a cross ledge 60 that is formed with various spaced, laterally extending slots 61–63. Door frame 40 also includes a top wall 65, a bottom wall 66 and lateral side walls 67 and 68. As indicated above, outer door panel 48 is preferably molded of plastic such that main body portion 52, cross ledge 60 and walls 65–68 are integrated to define a unitary piece.

Each of side walls 67 and 68 are undercut, such as that indicated at 71. With this arrangement, the lowermost portions (not separately labeled) of side walls 67 and 68 are recessed relative to the upper portions (also not separately labeled) of control panel 24 for the reasons which will be clearly identified below. Side walls 67 and 68 also include respective side edges 76 and 77, each of which is formed with vertically spaced grooved portions 80–82. Each grooved portion 80–82 preferably leads into a respective grooved zone 85–87 provided in a respective side wall 67, 68. At the forwardmost portion of grooved zones 85–87, side walls 67 and 68 are formed with elongated openings 88–90. Between elongated opening 89 and grooved portion 81 on each side wall 67, 68, a respective bore or opening 92 is provided as clearly shown in FIG. 3. As also shown in these Figures, door frame 40 is preferably molded with respective corner bosses 94–97, each of which has an associated bore 100.

Figures 4, 5:
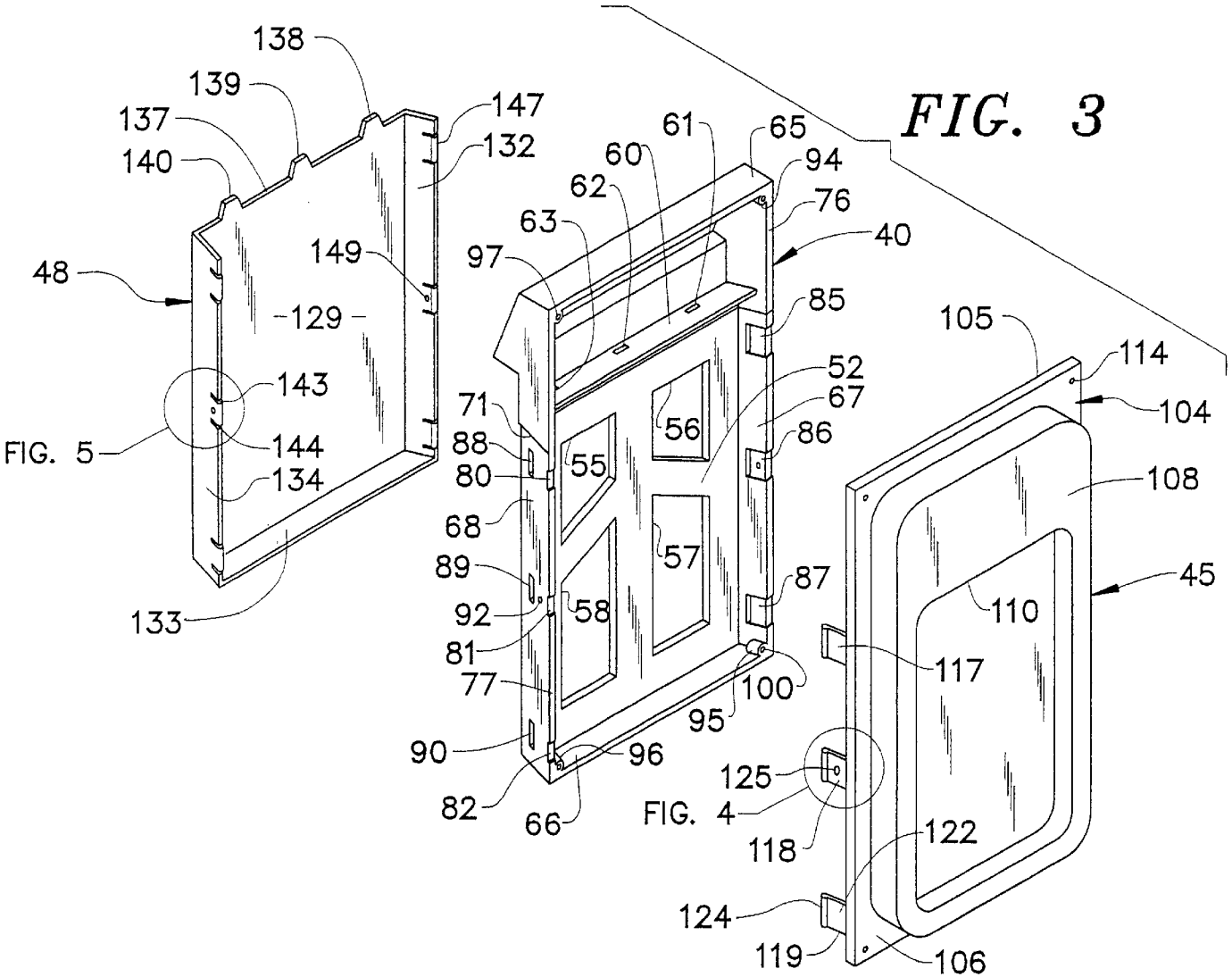
FIG. 4 is an enlarged perspective view of tab structure provided on an inner door panel of the door assembly.
FIG. 5 is an enlarged perspective view of tab structure provided on an outer door panel of the door assembly.
Figure 5:
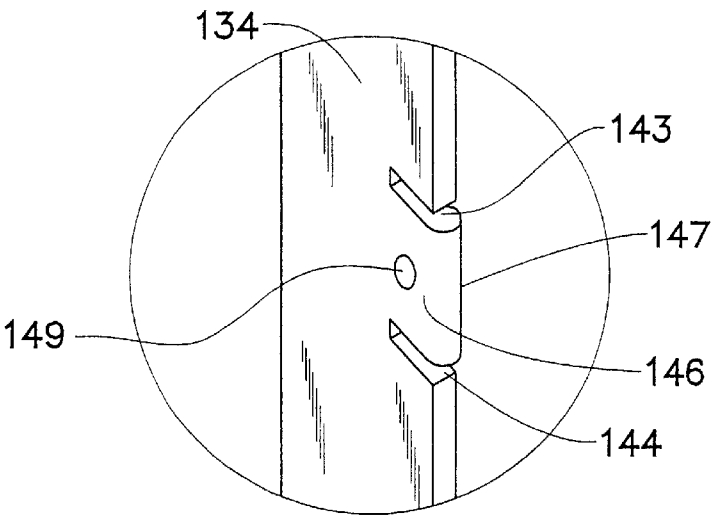
Figure 4:
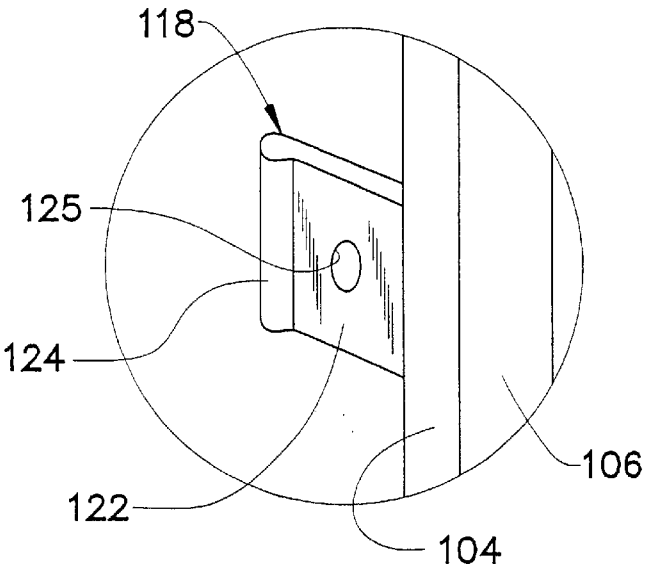

Inner door panel 45 is preferably defined by a main panel portion 104 having opposing faces 105 and 106, as well as a body portion 108. In a manner generally analogous to door frame 40, inner door panel 45 is also preferably molded of plastic. As shown, body portion 108 includes a cut-out section 110. In general, cut-out section 110 is provided to enable a portion of a door liner (not shown) to extend therein. As shown, main panel portion 104 includes various corner apertures 114 and, extending from face 105, a plurality of vertically spaced side tabs 117–119. As clearly shown in FIGS. 3 and 4, each side tab 117–119 includes a planar portion 122 which projects from face 105 and which terminates in an enlarged bead portion 124. Each bead portion 124 is preferably rounded to enhance assembly of inner door panel 45 to door frame 40 as will be more fully discussed below. In accordance with the most preferred form of the invention, at least tab 118 is provided with a through opening 125. Of course, although not shown based on the view taken, it should be readily apparent that a corresponding set of tabs 117–119 are provided on an opposing side edge of inner door panel 45.

In accordance with the invention, outer door panel 48 can vary in color and style and represents a component of door assembly 17 which can be separately selected by a consumer upon purchasing of a dishwasher 2. In the embodiment shown, outer door panel 48 includes a main panel portion 129 having in-turned side walls 132–134. In a manner analogous to door frame 40 and inner door panel 45, outer door panel 48 is also preferably molded of plastic. As shown, main panel portion 129 includes an upper edge 137 formed with various laterally spaced and tapering projections 138–140. In addition, as clearly shown in each of FIGS. 2, 3 and 5, each of side walls 132 and 134 are provided with vertically spaced sets of cut-outs, such as that indicated at 143 and 144. Each set of cut-outs 143 and 144 defines a respective cantilevered tab 146 which, in a manner analogous to tabs 117–119, preferably terminates in an elongated bead portion 147. However, while tabs 117–119 have bead portions 124 which project outwardly therefrom, bead portions 147 provided on cantilevered tabs 146 project inward. Furthermore, in a manner directly analogous to the incorporation of opening 125 and tab 118, at least one cantilevered tab 146 provided on each side wall 132 and 134 is preferably provided with an opening 149.

With this construction, dishwasher door assembly 17 can be readily assembled in an easy and convenient manner. More particularly, door 17 is assembled by connecting inner door panel 45 to door frame 40 after the positioning of control components behind panel 24 and thermal and/or sound insulation between main body portion 52 of door frame 40 and main panel portion 104 of inner door panel 45. During assembly, each set of tabs 117–119 provided along a respective edge of main panel portion 104 is slidably received within a respective grooved zone 85–87. The lateral space between the sets of tabs 117–119 provided on each side of main panel portion 104 causes tabs 117–119 to slightly deflect inward during assembly of inner door panel 45 to door frame 40 until the enlarged bead portion 124 of a respective tab 117–119 is received within a corresponding slot 88–90. At this point, tabs 117–119 are deflected laterally outwardly to retain inner door panel 45 to door frame 40. Therefore, with this arrangement, inner door panel 45 is snap-fittingly connected to door frame 40, with the interaction between tabs 117–119 and grooved zones 85–87 aiding in assuring a proper alignment for ease of assembly. Once this attachment is made, apertures 114 provided on main panel portion 104 are automatically aligned with bores 100. This alignment can be advantageously utilized in connecting an inner door liner (not shown), to the overall door assembly 17, while also permitting a further mechanical attachment between inner door panel 45 and door frame 40. In the most preferred form of the invention, threaded screws are utilized for this purpose.

As indicated above, a consumer purchasing dishwasher 2 would be able to select a particular outer door panel 48 from various designs which differ in color and/or style. Once a particular outer door panel 48 is selected, the outer door panel 48 would be interconnected to door frame 40. In accordance with the most preferred form of the invention described above, this interconnection would be performed by initially sliding projections 138–140 into respective slots 61–63. Thereafter, outer door panel 48 is pivoted to position in-turned side walls 132–134 about side wall 67, bottom wall 66 and side walls 68 respectively. During this movement of outer door panel 48, cantilevered tabs 146 are forced to project laterally outwardly until elongated bead portion 147 of each cantilevered tab 146 reaches a respective grooved portion 80–82. At this point, the cantilevered tabs 146 will shift laterally inwardly to securely attach outer door panel 48 to door frame 40. Therefore, with this arrangement, it should be readily apparent that outer door panel 48 is also snap-fittingly connected to door frame 40, with the cooperation between elongated bead portion 147 and grooved portions 80–82 assuring a proper alignment and fit. Due to the presence of undercut 71, a smooth transition is defined between control panel 24 and outer door panel 48. Once assembled in this manner, openings 92, 125 and 149 will be aligned. A mechanical fastener 150, which can constitute a threaded fastener or a serrated plastic insert, is placed within aligned openings 92, 125 and 149.

Based on the above, it should be readily apparent that the dishwasher door assembly of the present invention is lightweight, can be easily assembled, requires an efficient number of parts and advantageously enables the use of a selectable, decorative outer door panel which can vary in color, shape and the like. In any event, although described with respect to a preferred embodiment of the invention, it should be readily understood that various changes and/or modifications can be made to the invention without departing from the spirit thereof. In general, the invention is only intended to be limited by the scope of the following claims.

We claim:

1. In a dishwasher including a tub defining a washing chamber, a dishwasher door assembly mounted for movement relative to the tub in order to selectively access the washing chamber, said dishwasher door assembly comprising:

a door frame including a main body portion and a plurality of walls extending from the main body portion; and a decorative outer door panel including a main panel portion and a plurality of in-turned side walls, said outer door panel being snap-fittingly attached to the door frame, with the plurality of in-turned side walls extending over the plurality of walls.

2. The dishwasher door assembly according to claim 1, further comprising: a plurality of tabs provided on one of the door frame and the outer door panel for use in attaching the outer door panel to the door frame.

3. The dishwasher door assembly according to claim 2, wherein the plurality of tabs are provided on the outer door panel.

4. The dishwasher door assembly according to claim 3, wherein the plurality of tabs are defined by portions of the in-turned side walls.

5. The dishwasher door assembly according to claim 3, further comprising:

a plurality of spaced grooves formed on the door frame; and a plurality of elongated bead elements, with each of the bead elements being provided on a respective one of the plurality of tabs, wherein the bead elements are adapted to be received in the grooves upon snap-fittingly attaching the outer door panel to the door frame.

6. The dishwasher door assembly according to claim 5, wherein the plurality of tabs are formed on the in-turned side walls of the outer door panel and the grooves are provided in the walls of the door frame.

7. The dishwasher door assembly according to claim 6, wherein each of the plurality of walls of the door frame includes an edge portion, said grooves being formed in the edge portion.

8. The dishwasher door assembly according to claim 3, further comprising:

a plurality of projections extending from the outer door panel; and a plurality of slots formed in the door frame, wherein the projections are received in the slots prior to snap-fittingly attaching the outer door panel to the door frame.

9. A dishwasher door assembly comprising:

a door frame including a main body portion and a plurality of walls extending from the main body portion;

a decorative outer door panel including a main panel portion and a plurality of in-turned side walls, said outer door panel being snap-fittingly attached to the door frame, with the plurality of in-turned side walls extending over the plurality of walls; and an inner door panel snap-fittingly attached to the door frame on a side opposite the outer door panel.

10. The dishwasher door assembly according to claim 9, further comprising: a plurality of tabs provided on one of the door frame and the inner door panel for use in attaching the inner door panel to the door frame.

11. The dishwasher door assembly according to claim 10, further comprising: a plurality of grooved zones formed in the door frame, said tabs extending into the grooved zones upon snap-fittingly attaching the inner door panel to the door frame.

12. The dishwasher door assembly according to claim 11, further comprising: a plurality of slots formed in the door frame, said grooved zones leading to said slots, wherein a portion of a respective one of said tabs extends into a respective said slot upon snap-fittingly attaching the inner door panel to the door frame.

13. The dishwasher door assembly according to claim 9, further comprising: a plurality of bosses provided on the door frame, said inner door panel being formed with a plurality of apertures, with each of the apertures being aligned with a respective one of said bosses, wherein each of the apertures is adapted to receive a mechanical fastener for fixedly interconnecting the inner door panel to the door frame at the bosses.

14. The dishwasher door assembly according to claim 9, further comprising:

a first set of tabs provided on the outer door panel; and a second set of tabs extending from the inner door panel, wherein the inner door panel is snap-fittingly attached to the door frame through the second set of tabs and the outer door panel is snap-fittingly attached to the door frame through the first set of tabs.

15. The dishwasher door assembly according to claim 14, wherein the walls of the door frame are formed with a plurality of grooved sections and zones, wherein the first and second sets of tabs are received within respective ones of the grooved sections and zones.

16. The dishwasher door assembly according to claim 15, further comprising:

a plurality of projections extending from the outer door panel; and a plurality of slots formed in the door frame, wherein the projections are received in the slots prior to snap-fittingly attaching the outer door panel to the door frame.

17. The dishwasher door assembly according to claim 14, wherein respective ones of the first and second sets of tabs are aligned and laterally overlapped.

18. The dishwasher door assembly according to claim 17, wherein at least one of each of the first and second sets of tabs is formed with aligned openings.

19. The dishwasher door assembly according to claim 18, further comprising: a mechanical fastener extending through the aligned openings.

20. The dishwasher door assembly according to claim 9, wherein each of the door frame, inner door panel and outer door panel are formed of plastic.

21. A method of assembling a dishwasher comprising:

forming a tub which defines a washing chamber;

assembling a dishwasher door by:

molding a plastic door frame to include a main body portion and a plurality of walls extending from the main body portion;

molding a decorative outer door panel to include a main panel portion and a plurality of in-turned side walls; and snap-fittingly attaching the outer door panel to the door frame with the plurality of in-turned side walls extending over the plurality of walls; and attaching the dishwasher door for movement relative to the tub in order to selectively access the washing chamber.

22. The method of assembling a dishwasher door according to claim 21, wherein the outer door panel is snap-fittingly attached to the door frame by positioning tabs within mating grooves.

23. The method of assembling a dishwasher door according to claim 21, further comprising:

initially interconnecting the outer door panel to the door frame through mating projections and slots; and pivoting the outer door panel to snap-fittingly attach the outer door panel to the door frame.

24. A method of assembling a door comprising:

molding a plastic door frame to include a main body portion and a plurality of walls extending from the main body portion;

molding a decorative outer door panel to include a main panel portion and a plurality of in-turned side walls;

snap-fittingly attaching the outer door panel to the door frame with the plurality of in-turned side walls extending over the plurality of walls; and snap-fittingly attaching an inner door panel to a side of the door frame opposite the outer door panel.

25. The method of assembling a dishwasher door according to claim 24, further comprising: interconnecting each of the outer door panel, door frame and inner door panel through at least one mechanical fastener.

* * * * *